US006257921B1

(12) United States Patent
Kuo et al.

(10) Patent No.: US 6,257,921 B1
(45) Date of Patent: Jul. 10, 2001

(54) CABLE CONNECTOR HAVING A DEVICE FOR FIXEDLY ANCHORING A CABLE AT AN ANGLED POSITION

(75) Inventors: Chin Pao Kuo, Taipei; Peter Kuo, Chung-Ho, both of (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/491,696

(22) Filed: Jan. 26, 2000

(30) Foreign Application Priority Data

Dec. 17, 1999 (TW) ..... 88221566

(51) Int. Cl.[7] ..... H01R 13/58
(52) U.S. Cl. ..... 439/457
(58) Field of Search ..... 439/456–459, 439/573

(56) References Cited

U.S. PATENT DOCUMENTS 5,380,220 * 1/1995 Huang ..... 439/457
5,616,052 * 4/1997 Pan et al. ..... 439/573
5,803,766 * 9/1998 Yang ..... 439/573
5,848,916 * 1/1995 Huang ..... 439/457

* cited by examiner

*Primary Examiner*—Gary F. Paumen
(74) *Attorney, Agent, or Firm*—Wei Te Chung

(57) ABSTRACT

A cable connector comprises an electrical connector part, a cable and a fixing member. The electrical connector comprises an over-mold, a shell extending from and out of the over-mold and a plug extending out of the shell. The fixing member defines an aperture therethrough for receiving a signal cable and forms a locking protrusion on a face thereof below the aperture. The over-mold has a top wall, a front wall and two sidewalls. A receiving channel defined in the top wall extending from a middle of the top wall to the front wall for receiving the cable. A recess is defined on a front wall below the receiving channel for receiving the locking protrusion of the fixing member. During assembly, the aperture of the fixing member receives the cable and the fixing member slides along the cable towards the over-mold. The locking protrusion are received in the recess of the over-mold thus anchoring an angled cable in the connector.

2 Claims, 4 Drawing Sheets

CABLE CONNECTOR HAVING A DEVICE FOR FIXEDLY ANCHORING A CABLE AT AN ANGLED POSITION

BACKGROUND OF THE INVENTION

1. Field of the Invention

The present invention relates to a cable connector, and particularly to a cable connector which can fixedly anchor a cable at an angled position.

2. Description of Prior Art

A prior art cable connector is disclosed in Taiwan patent application No. 77210069 as shown in FIG. 4. In order to fix a cable 3' in a connector 1' at an angled position, a semicircle metallic retainer 5' is used having two opposite apertures 51' on both sides thereof for extension of screws 4' to clamp the cable 3' at the given angled position. A plurality of wires 31 of cable 3' are extended into the connector to connect with terminals (not shown) of the connector 1'. The conventional connector can fix a cable at the angled position, but the use of the metallic retainer 5' and the screws 51' is cost and not convenient. Hence an improved device for anchoring a cable of a cable connector at an angled position is required to overcome the disadvantages of the prior art.

SUMMARY OF THE INVENTION

An object of the present invention is to provide a cable connector that can fixedly anchor an angled cable therein and that is easily produced and low cost.

A cable connector for anchoring an angled cable therein comprises an electrical connector part, a cable and a fixing member. The fixing member has opposite large and small arced portions, opposite upper and lower faces, an aperture defined through the upper and lower faces about the large arced portion for receiving a cable, a locking protrusion formed on the lower face about the small arced portion. The electrical connector includes an over-mold, a shell and a plug. The over-mold has a top wall, a front wall and two sidewalls. A receiving channel defined in the top wall, extending from a middle of the top wall to the front wall for receiving the cable. A recess is defined on a front wall below the receiving channel for receiving the locking protrusion of the fixing member. The shell extends out of the over-mold and the plug extends out of the shell. When assembly, the aperture of the fixing member receives the cable and the fixing member slides along the cable towards the over-mold. The locking protrusion are received in the hole of the over-mold thus anchoring an angled cable in the connector.

Other objects, advantages and novel features of the invention will become more apparent from the following detailed description of the present embodiment when taken in conjunction with the accompanying drawings.

DETAILED DESCRIPTION OF THE INVENTION

Figure 1:
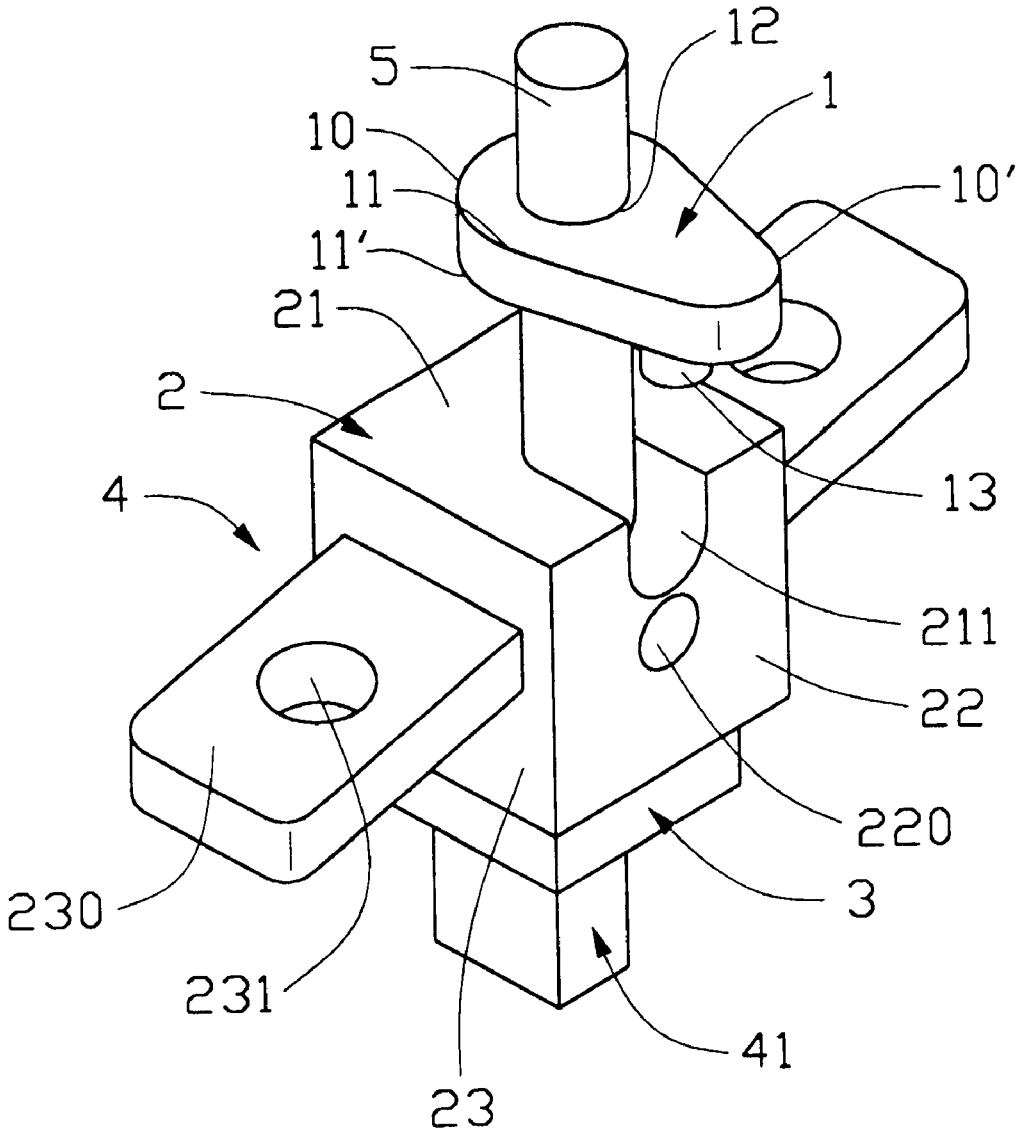
FIG. 1 is a perspective view showing a pre-assembled condition of a connector in accordance with the present invention wherein a cable is in a vertical aspect.

Referring to FIG. 1, a cable connector in accordance with the present invention comprises an electrical connector part 4, a cable 5 and a fixing member 1.

The fixing member 1 formed by plastic injection molding to general has opposite large and small arced portions 10, 10', upper and lower faces 11, 11', an aperture 12 defined through the upper and lower faces 11, 11' about the large arced portion 10, and a locking protrusion 13 projecting downwardly from the lower face 11' about the small arced portion 10'. The fixing member 1 is assembled to the cable 5 by extending the cable 5 through the aperture 12.

The electrical connector part 4 comprises an over-mold 2, a shell 3 downwardly extending from and out of the over-mold 2 and a plug 41 at a bottom of the over-mold 2 for connection with a peripheral equipment (not shown). The over-mold 2 has a top wall 21, a front wall 22 and two sidewalls 23. A receiving channel 211 is defined in the top wall 21 extending from a middle of the top wall 21 to the front wall 22. The channel 211 has a semi-circular cross section for conformingly receiving the cable 5 therein when the cable 5 is bent perpendicularly relative to the front wall 22. A locking recess 220 is defined in a front wall 22 below the receiving channel 211 for receiving the locking protrusion 13 of the fixing member 1 therein. A fixing wing 230 is formed on each sidewall 23 laterally extending in a given angle for cooperating with a fixing device of a frame (not shown) to mount the connector part 4 in the frame. The fixing wing 230 is rectangular shape and has an aperture 231 in a central portion thereof for extension of a screw (not shown) thereby fixing the connector part 4 to the frame.

Figure 2:
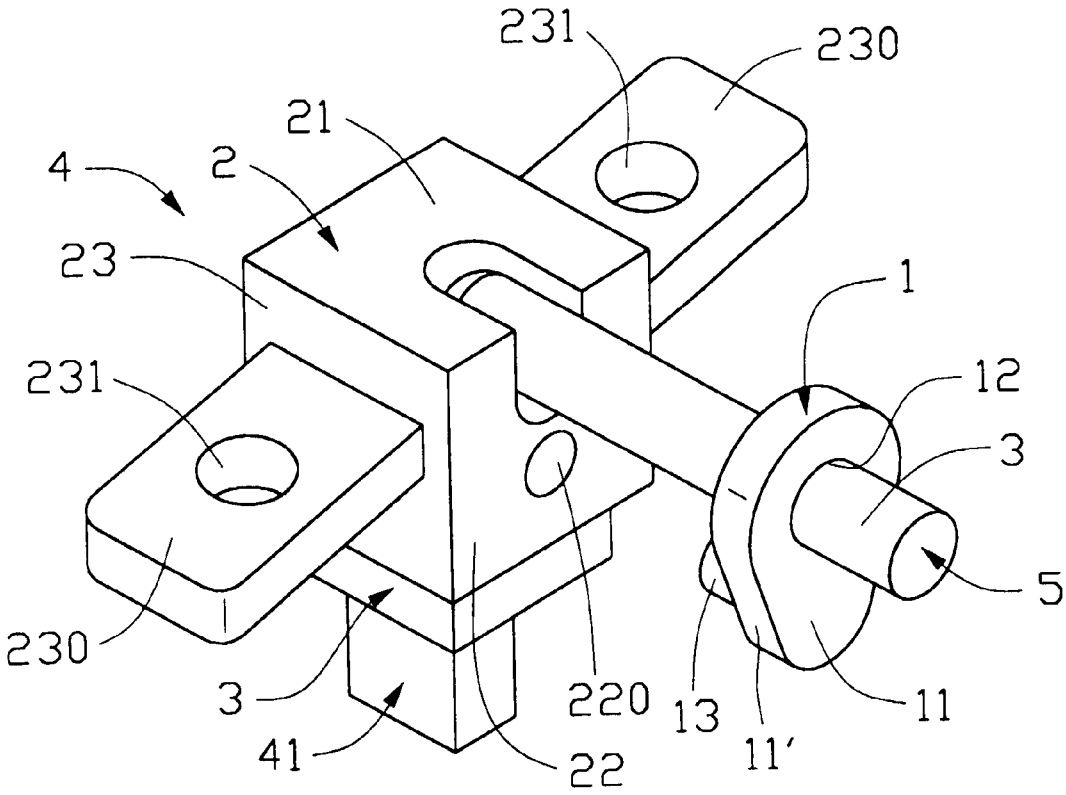
FIG. 2 is a view similar to FIG. 1 showing the cable in a horizontal aspect.
Figure 3:
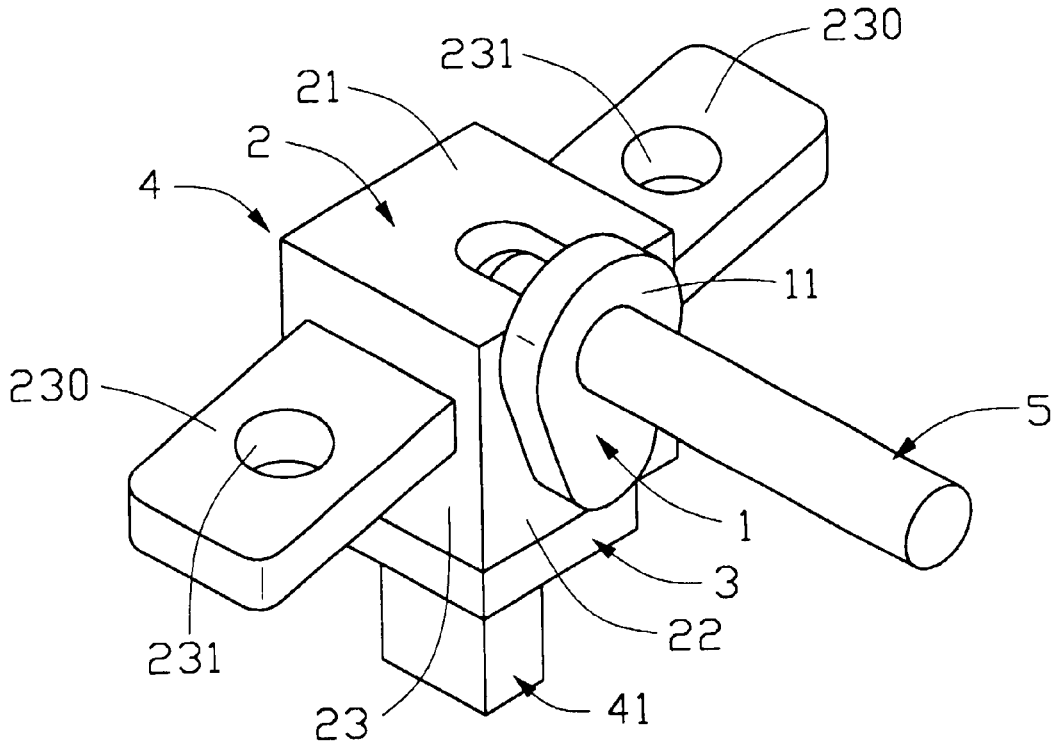
FIG. 3 is view similar to FIG. 1, showing an assembled condition of the connector.
Figure 4:
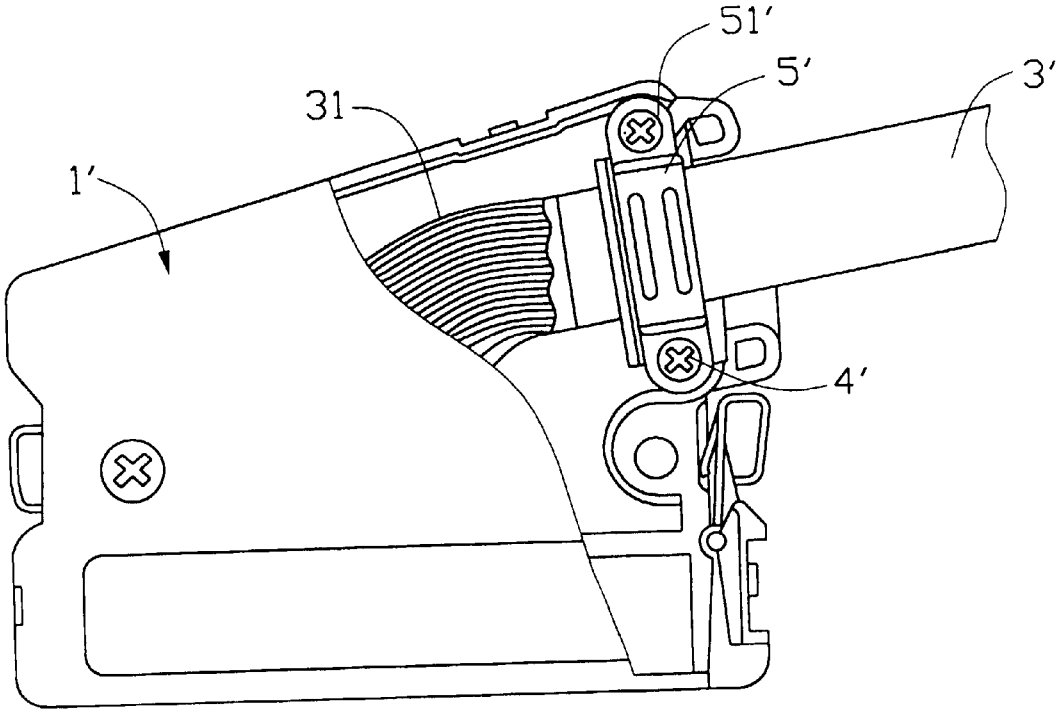
FIG. 4 (PRIOR ART)
FIG. 4 is a side elevational view of an electrical connector in accordance with the prior art.

Referring to FIGS. 1–3, when assembly, a first end of the cable 5 which has an opposite second end with wires (not shown) connected to terminals (not shown) of the connector part 4, is extended through the aperture 12 of the fixing member 1 to reach a position as shown in FIG. 1. Then the cable 5 is bent about 90 degrees and received in the receiving channel 211 in the top wall 21 of the over-mold 2, as shown in FIG. 2. Finally, the fixing member 1 slides along the cable 6 towards the front wall 22 of the over-mold 2 to reach a position in which the locking protrusion 13 is received in the recess 220 and has an interferential fit with the over-molder 2. Thus, the cable 5 is fixedly anchored at the position as shown in FIG. 3

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector comprising:

an electrical connector part defining an over-mold defining opposite top and bottom walls;

a cable extending through said over-mold with an exposed portion projecting out of the top wall;

a plug extending from the bottom wall and connected to said cable thereabouts; and said over-mold defining a receiving channel extending openly along the top wall; wherein the exposed portion of said cable is bent at an angle to be generally fully received within said receiving channel in compliance with the top wall, wherein a fixing member is disposed on the exposed portion of the cable, and said fixing member includes a locking protrusion which is latchably engaged within a corresponding recess formed in said over-mold;

wherein said locking protrusion extends along the same direction with the exposed portion of the cable;

wherein said recess extends along the same direction with the receiving channel;

wherein said fixing member is moveable along said exposed portion of the cable.

2. A method for assembling a cable connector, comprising the steps of:

providing an electrical connector part with an over-mold, said over-mold defining a receiving channel in one wall;

providing a cable extending through said over-mold with an exposed portion protruding out of said wall;

attaching a fixing member to said cable;

providing a plug on said over-mold away from said wall while connected to said cable;

providing a locking recess in said over-mold; and deflecting the exposed portion of the cable with the associated fixing member latchably engaged within the corresponding locking recess so as to maintain the exposed portion of the cable at an angle with regard to the plug;

wherein said fixing member is moveable along the exposed portion of the cable;

wherein said fixing member is moved toward the over-mold for engaging the locking protrusion within the locking recess after the exposed portion the cable has been deflected;

wherein said locking recess is formed in another wall perpendicular to said wall.

* * * * *